US007030842B2

(12) United States Patent
Ha et al.

(10) Patent No.: US 7,030,842 B2
(45) Date of Patent: Apr. 18, 2006

(54) ELECTRO-LUMINESCENCE DISPLAY DEVICE AND DRIVING METHOD THEREOF

(75) Inventors: Yong Min Ha, Kumi-shi (KR); Hoon Ju Chung, Pyungtaek-shi (KR); Han Sang Lee, Kunpo-shi (KR); Myung Ho Lee, Uiwang-shi (KR); Seok Hee Jeong, Daegu (KR)

(73) Assignee: LG.Philips LCD Co., Ltd., Seoul (KR)

( * ) Notice: Subject to any disclaimer, the term of this patent is extended or adjusted under 35 U.S.C. 154(b) by 77 days.

(21) Appl. No.: 10/692,732

(22) Filed: Oct. 27, 2003

(65) Prior Publication Data

US 2004/0124780 A1 Jul. 1, 2004

(30) Foreign Application Priority Data

Dec. 27, 2002 (KR) ..... 10-2002-0084784
Dec. 31, 2002 (KR) ..... 10-2002-0088204

(51) Int. Cl.
*G09G 3/30* (2006.01)

(52) U.S. Cl. ..... 345/76; 345/77; 345/82

(58) Field of Classification Search ..... 345/76–82, 345/87–89, 211, 214
See application file for complete search history.

(56) References Cited

U.S. PATENT DOCUMENTS

2002/0109655 A1* 8/2002 Yer et al. ..... 345/87
2002/0126112 A1* 9/2002 Kato ..... 345/204
2002/0149575 A1* 10/2002 Moon ..... 345/204
2003/0122814 A1* 7/2003 Yer ..... 345/211

FOREIGN PATENT DOCUMENTS

JP 01-105295 4/1989
JP 08-263019 10/1996

* cited by examiner

*Primary Examiner*—Xiao Wu
(74) *Attorney, Agent, or Firm*—McKenna Long & Aldridge LLP

(57) ABSTRACT

An electro-luminescence display device includes a supply voltage source; a data driver for driving a plurality of data lines arranged within a panel; a gamma voltage generator for generating gamma voltages to generate analog data voltages corresponding to externally inputted data signals provided to the data driver; and a threshold voltage compensator installed between the gamma voltage generator and the supply voltage source for controlling a supply voltage of the supply voltage source and to apply the controlled voltage to the gamma voltage generator.

28 Claims, 8 Drawing Sheets

ELECTRO-LUMINESCENCE DISPLAY DEVICE AND DRIVING METHOD THEREOF

This application claims the benefit of Korean Patent Application Nos. P2002-84784 filed Dec. 27, 2002 and P2002-88204 filed on Dec. 31, 2002, which are hereby incorporated by reference for all purposes as if fully set forth herein.

BACKGROUND OF THE INVENTION

1. Field of the Invention

The present invention relates to electro-luminescence display devices and methods of driving the same, and more particularly to an electro-luminescence display device and a method of driving the same, capable of compensating differences in brightness to which pictures are displayed by panels in an electro-luminescence display device.

2. Description of the Related Art

Until recently, cathode ray tubes (CRTs) have generally been used in display systems. However, use of newly developed flat panel displays such as liquid crystal displays (LCDs), field emission displays (FEDs), plasma display panels (PDPs), and electro-luminescence (EL) devices are becoming increasingly common due to their low weight, thin dimensions, and low power consumption.

Generally, EL devices are self-luminous devices and include fluorescent bodies capable of emitting light when electrons are recombined with holes. Depending on the compounds used in the fluorescent body, EL devices are classifiable as inorganic EL devices, containing inorganic compounds, or as organic EL devices, containing organic compounds. Generally, EL devices have excellent response speeds and light emission characteristics and are capable of displaying images at a high brightness and over wide ranges of viewing angles. Therefore, it can be reasonably anticipated that EL devices will be widely used in the future.

Organic EL devices typically include an electron injection layer, an electron transport layer, a light-emitting layer, a hole transport layer, and a hole injection layer arranged between a cathode and an anode. If a specific voltage is applied between the anode and the cathode of an organic EL device (OELD), electrons generated at the cathode migrate to the light-emitting layer via the electron injection and electron transport layers while holes generated at the anode migrate to the light-emitting layer via the hole injection and hole transport layers. Accordingly, electrons and holes supplied from the electron and hole transport layers are recombined in the light-emitting layer, causing the light-emitting layer to emit light.

FIG. 1 illustrates a schematic view of an active matrix related art organic electro-luminescence device.

Referring to FIG. 1, a related art organic EL device (OELD) can be provided as an active matrix type display and include an EL panel 20 having a plurality of pixels 28 arranged at areas defined by crossings of scan lines SL and data lines DL, a scan driver 22 for driving the scan lines SL of the EL panel 20, a data driver 24 for driving the data lines DL of the EL panel 20, and a gamma voltage generator 26 for applying a plurality of gamma voltages.

Generally, the scan driver 22 sequentially applies scan pulses to the scan lines SL and the data driver 24 converts externally inputted digital data signals into analog data signals using the gamma voltages applied from the gamma voltage generator 26. Further, the data driver 24 applies the analog data signals to the data lines DL in synchrony with the application of the scan pulses. Each of the plurality of pixels 28 receives an analog data signal from the data lines DL and, when the scan pulses are applied to the scan lines SL, generate light corresponding to the received analog data signal.

FIG. 2 illustrates a related art pixel within the active matrix related art organic electro-luminescence device shown in FIG. 1.

Referring to FIG. 2, each pixel 28 includes an organic electro-luminescence (OEL) cell having a cathode connected to a ground voltage source GND, a cell driver 30 connected to a scan line SL, data line DL, a supply voltage source VDD, and an anode of the OEL cell for driving the OEL cell.

The cell driver 30 includes a switch thin film transistor (TFT) T1 having a gate terminal connected to the scan line SL, a source terminal connected to the data line DL, and a drain terminal connected to a first node N1; a drive TFT T2 having a gate terminal connected to the first node N1, a source terminal to the supply voltage source VDD, and a drain terminal connected to the OEL cell; and a capacitor C connected between the supply voltage source VDD and the first node N1.

When a scan pulse is applied from the scan line SL, the switch TFT T1 is turned on and an analog data signal applied from the data line DL is transmitted to the first node N1. The analog data signal applied to the first node N1 is then simultaneously charged to the capacitor C and applied to the gate terminal of the drive TFT T2. In response to the analog data signal applied from the data line DL, the drive TFT T2 controls the amount of current, I, that is applied to the OEL cell from the supply voltage source VDD. By controlling the amount of current applied to the OEL cell, the drive TFT T2 controls the luminescence characteristics of the OEL cell. When the switch TFT T1 is turned off, the analog data signal stored by the capacitor C is discharged, enabling the drive TFT T2 to apply the current, I, from the supply voltage source VDD to the OEL cell. Accordingly, the luminescence characteristics of the OEL cell are maintained uniformly until an analog data signal of a successive frame is applied from the data line DL.

As described above, the related art electro-luminescence applies current signals to each of the OEL cells, wherein the strength of the applied current corresponds to digital data signals inputted into the data driver. Upon applying the current to the OEL cells, the electro-luminescence displays pictures. The related art OELD displays color by providing the OEL cells as R OEL cells having a red (R) fluorescent body, G OEL cells having a green (G) fluorescent body, and B OEL cells having a blue (B) fluorescent body, wherein sets of individual R, G, and B OEL cells are combined within a pixel.

The efficiency with which each of the R, G, and B fluorescent bodies emit light vary with the color of each fluorescent body. Accordingly, when analog data signals having a constant level are applied to the R, G, and B OEL cells, the R OEL cells emit light at a different brightness than the G OEL cells, the G OEL cells emit light at a different brightness than the B OEL cells, and the B OEL cells emit light at a different brightness than the R OEL cells. Therefore, gamma voltages are generally applied by the gamma voltage generator 26 to equalize the brightness at which each set of R, G, and B OEL cells emit light, enabling a pixel containing R, G, and B OEL cells to express white light. Related art gamma voltage generators 26 generally include gamma voltage suppliers that generate gamma voltages specific to each R, G, and B OEL cell within the pixel.

FIG. 3 illustrates a detailed circuit configuration of a first type within the related art gamma voltage generator shown in FIG. 1.

Referring to FIG. 3, the related art gamma voltage generator 26 shown in FIG. 1 includes a plurality of gamma voltage suppliers (e.g., R, G, and B, gamma voltage suppliers) corresponding to each of the R, G, and B OEL cells. Each of the plurality of gamma voltage suppliers generates n number of gamma voltages GAMMA1 to GAMMAn (where n is a natural number). The n gamma voltages are then used to generate analog data signals having different brightness levels, in correspondence with the digital data signals externally inputted to the data driver. For convenience of illustration, however, only one gamma voltage supplier is illustrated. Within the related art gamma voltage generator, each gamma voltage supplier includes a plurality of resistor pairs R1R2, R3R4, R5R6, R7R8, . . . , R2*n*–1R2*n* connected to one another in parallel between the supply voltage source VDD and the ground voltage source GND. The plurality of resistor pairs divide a supply voltage applied from the supply voltage source VDD and generate the n gamma voltages GAMMA1 to GAMMAn. Subsequently, the n gamma voltages are applied to the data driver 24. Electromagnetic noise of the gamma voltages GAMMA1 to GAMMAn, generated by the resistor pairs R1R2, R3R4, R5R6, R7R8, . . . , R2*n*–1R2*n* can be eliminated by the amplifiers 31 to 35 before the gamma voltages GAMMA1 to GAMMAn are applied to the data driver 24. The data driver 24 converts externally inputted digital data signals into analog data signals using any one of the gamma voltages GAMMA1 to GAMMAn. Subsequently, the converted analog data signals are applied to the data lines DL, causing predetermined pictures to be displayed by the EL panel 20.

FIG. 4 illustrates a detailed circuit configuration of a second type within the related art gamma voltage generator shown in FIG. 1.

Referring to FIG. 4, the gamma voltage generator 26 includes a single gamma voltage supplier for generating n number of gamma voltages GAMMA1 to GAMMAn. The n gamma voltages are then used to generate analog data signals having different brightness levels, in correspondence with the digital data signals externally inputted to the data driver. Accordingly, the gamma voltage supplier includes (n+1) number of resistors R11, R12, R13, R14, . . . , R1*n*+1 connected in series between the supply voltage source VDD and a ground voltage source GND to generate n number of gamma voltages GAMMA1 to GAMMAn. Subsequently, the n gamma voltages GAMMA1 to GAMMAn are applied to the data driver 24. The data driver 24 generates analog data signals using gamma voltages GAMMA1 to GAMMAn in correspondence with the externally inputted digital data signals. Application of the generated analog data signals to the data lines DL is synchronized with the application of the scan signals, causing predetermined pictures to be displayed by the EL panel 20.

Within the related art electro-luminescence device described above, the amount of current, I, flowing to each of the OEL cells is determined by the gate voltage of the drive TFT T2 (i.e., the voltage of the analog data signal applied to the gate terminal of the drive TFT T2). However, the amount of current, I, that is transmitted by the drive TFT T2 is influenced by a threshold voltage Vth of the drive TFT T2. Accordingly, if a voltage difference of the drive TFT T2 (i.e., a difference between the supply voltage applied from the supply voltage source VDD and the gate voltage) is greater than the threshold voltage Vth of the drive TFT T2, the drive TFT T2 is turned on.

Therefore, within display systems including a plurality of EL panels 20, the threshold voltages Vth of the drive TFTs T2 of the plurality of EL panels 20 must be equal to prevent the plurality of EL panels within the electro-luminescence display device from displaying pictures at different levels of brightness. Maintaining substantially identical threshold voltages Vth across a plurality of EL panels can be difficult because threshold voltages Vth of drive TFTs T2 typically vary with the manner in which the TFTs were fabricated. Accordingly, values of threshold voltages Vth of drive TFTs T2 can often vary from EL panel 20 to EL panel. If threshold voltages of drive TFT T2 in different EL panels 20 are different, the brightness at which pictures are displayed by EL panels within the electro-luminescence display device becomes undesirably non-uniform.

For example, a drive TFT T2 in a first EL panel of an electro-luminescence display device can have a threshold voltage Vth of 0.7V while a drive TFT T2 of a second EL panel of the electro-luminescence display device can have a threshold voltage Vth of 0.3V, wherein the supply voltage source VDD of the electro-luminescence display device applies a supply voltage of 10V. In the presence of an applied gate voltage of 9.5 V, the second EL panel may emit light because the voltage difference of the drive TFT T2 (i.e., 10V−9.5V=0.5V) is greater than the threshold voltage of the drive TFT T2 of the second EL panel (i.e., 0.3V). However, no pictures can be displayed by the first EL panel because the voltage difference of the drive TFT T2 (i.e., 10V−9.5V=0.5V) is lower than the threshold voltage of the drive TFT T2 of the first EL panel (i.e., 0.7V). Accordingly, the brightness with which pictures are displayed by the first and second EL panels within the electro-luminescence display device is undesirably non-uniform due to differences in threshold voltages Vth of the related art drive TFTs T2 within the first and second EL panels.

SUMMARY OF THE INVENTION

Accordingly, the present invention is directed to an electro-luminescence-display device and method of driving the same that substantially obviates one or more of the problems due to limitations and disadvantages of the related art.

An advantage of the present invention provides an electro-luminescence display device and a method of driving the same capable of compensating differences in brightness to which pictures are displayed by panels in an electro-luminescence display device.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, an electro-luminescence display device may, for example, include: a panel having data lines; a supply voltage source for applying a supply voltage; a data driver for driving the data lines in response to externally inputted digital data signals; a gamma voltage generator for generating gamma voltages, the gamma voltages being usable in forming analog data signals corresponding to the externally inputted digital data signals; and a threshold voltage compensator arranged between the gamma voltage generator and the supply voltage source for controlling the supply voltage and for applying the controlled supply voltage to the gamma voltage generator.

In one aspect of the present invention, the panel may, for example, include pixels arranged in a matrix pattern, wherein each pixel includes an electro-luminescence cell and a drive thin film transistor for applying a current to the electro-luminescence cell, wherein the applied current corresponds to a reference voltage, wherein the reference voltage is substantially equal to the difference between a threshold voltage of the drive thin film transistor and the supply voltage.

In another aspect of the present invention, the threshold voltage compensator may lower a voltage level of the supply voltage and apply the lowered supply voltage to the gamma voltage generator.

In yet another aspect of the present invention, the threshold voltage compensator may apply a reference voltage to the gamma voltage generator, wherein the reference voltage is substantially equal to the difference between a threshold voltage of the drive thin film transistor and the supply voltage; and the gamma voltage generator may divide the reference voltage.

In still a further aspect of the present invention, the threshold voltage compensator may include at least one threshold voltage compensation thin film transistor.

In yet a further aspect of the present invention, the threshold voltage compensation thin film transistor may include a source electrode connected to the supply voltage source, a drain electrode connected to the gamma voltage generator, and a gate electrode connect to the gamma voltage generator.

In still a further aspect of the present invention, a threshold voltage of the threshold voltage compensation thin film transistor may be substantially equal to a threshold voltage of the drive thin film transistor.

In yet another aspect of the present invention, the gamma voltage generator may include a red gamma voltage supplier for generating a gamma voltage appliable to a red electro-luminescence cell; a green gamma voltage supplier for generating a gamma voltage appliable to a green electro-luminescence cell; and a blue gamma voltage supplier for generating a gamma voltage appliable to a blue electro-luminescence cell.

In still another aspect of the present invention, the threshold voltage compensator may include three threshold voltage compensation thin film transistors corresponding to the red, green, and blue gamma voltage generators.

In another aspect of the present invention, the electro-luminescence display device may further include a scan driver coupled to the panel for controlling the analog data signals, wherein the analog data signals are appliable to the drive thin film transistor; a scan tape carrier package for electrically connecting the scan driver to the panel; and a data tape carrier package for electrically connecting the data driver to the panel.

In one aspect of the present invention, the threshold voltage compensator may be connected to the gamma voltage generator via the scan tape carrier package or the data tape carrier package.

In another aspect of the present invention, the electro-luminescence display device may further include a flexible printed circuit for electrically connecting the threshold voltage compensator with the gamma voltage generator.

In accordance with the principles of another aspect of the present invention, an electro-luminescence display device may, for example, include panels each having data lines; a supply voltage source for applying supply voltages to each of the panels; data drivers coupled to each of the panels for receiving externally inputted data signals; and red, green, and blue gamma voltage suppliers coupled to each data driver for dividing the supply voltage into a plurality of gamma voltages having a predetermined number of voltage levels, the gamma voltages being usable in forming analog data signals corresponding to the externally inputted data signals, wherein each of the gamma voltage suppliers may, for example, include a fixed resistor and a variable resistor connected in series to the supply voltage source and to a ground voltage source for dividing the supply voltage; and a plurality of resistor pairs connected in parallel for generating the gamma voltages using of the divided voltages.

In one aspect of the present invention, a resistance of the variable resistor is adjustable such that pictures are displayable by the panels at a substantially uniform brightness.

In another aspect of the present invention, each of the panels may, for example, include pixels arranged in a pattern, wherein each of the pixels includes an electro-luminescence cell and a drive thin film transistor for applying a current to the electro-luminescence cell, wherein the applied current corresponds to the analog data signal.

In still another aspect of the present invention, a resistance of the variable resistor is adjustable to compensate for a threshold voltage of drive thin film transistors in each of the panels, wherein the threshold voltage of drive thin film transistors in different panels is different.

In accordance with the principles of still another aspect of the present invention, a method of driving an electro-luminescence may, for example, include providing panels; providing a power voltage control circuit in each of the panels; applying a common power voltage to each of the power voltage control circuits; controlling the common power voltage in each of the power voltage control circuits in accordance with unique properties of thin film transistors in different ones of the panels; and generating a gamma voltage within the panel using the controlled common power voltage.

In one aspect of the present invention, the power voltage control circuit may lower the common power voltage.

In another aspect of the present invention, the power voltage control circuit may lower the common power voltage substantially to a level substantially equal to the threshold voltage of the thin film transistors of the panels.

In accordance with the principles of yet another aspect of the present invention, a method of driving an electro-luminescence may, for example, include providing panels; providing a gamma voltage generator in each of the panels for generating gamma voltages; applying a common power voltage to each of the gamma voltage generators; and generating the gamma voltages in accordance with unique properties of thin film transistors in different ones of the panels.

In one aspect of the present invention, the gamma voltage generator may generate the gamma voltages such that pictures are displayable by the panels to substantially the same brightness when substantially identical data voltages are applied to the panels.

In accordance with the principles of yet another aspect of the present invention, an electro-luminescence display device may, for example, include panels; data drivers coupled to each of the panels for receiving externally inputted data signals; and gamma voltage generators for applying gamma voltages having a predetermined number of voltage levels to the data drivers, the gamma voltages being usable in forming analog data signals corresponding to the externally inputted data signals, wherein different ones of the gamma voltage generators apply different gamma voltages such that pictures are displayable by the panels at a substantially uniform brightness.

In one aspect of the present invention, each gamma voltage generator may include at least one variable resistor.

In another aspect of the present invention, a resistance of the variable resistor is adjustable such that pictures are displayable by the panels at a substantially uniform brightness.

In still another aspect of the present invention, the gamma voltage generator may include a gamma voltage supplier having a first and a second fixed resistor connected to a supply voltage source and a ground voltage source, respectively; and variable resistors arranged between the first and second fixed resistors.

In yet another aspect of the present invention, a resistance of the variable resistor may be adjustable such that pictures are displayable by the panels at a substantially uniform brightness regardless of a difference between threshold voltages of drive thin film transistors of the panels.

In yet a further aspect of the present invention, each of the panels may include electro-luminescence cells arranged in a matrix pattern; and drive thin film transistors for applying a current to each of the electro-luminescence cells, wherein the applied current corresponds to the analog data signal.

In still a further aspect of the present invention, the resistance of the variable resistor compensates for threshold voltages of drive thin film transistor of different panels.

In another aspect of the present invention, the gamma voltage generator may include a red gamma voltage supplier for generating a gamma voltage appliable to a red electro-luminescence cell; a green gamma voltage supplier for generating a gamma voltage appliable to a green electro-luminescence cell; and a blue gamma voltage supplier for generating a gamma voltage appliable to a blue electro-luminescence cell.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
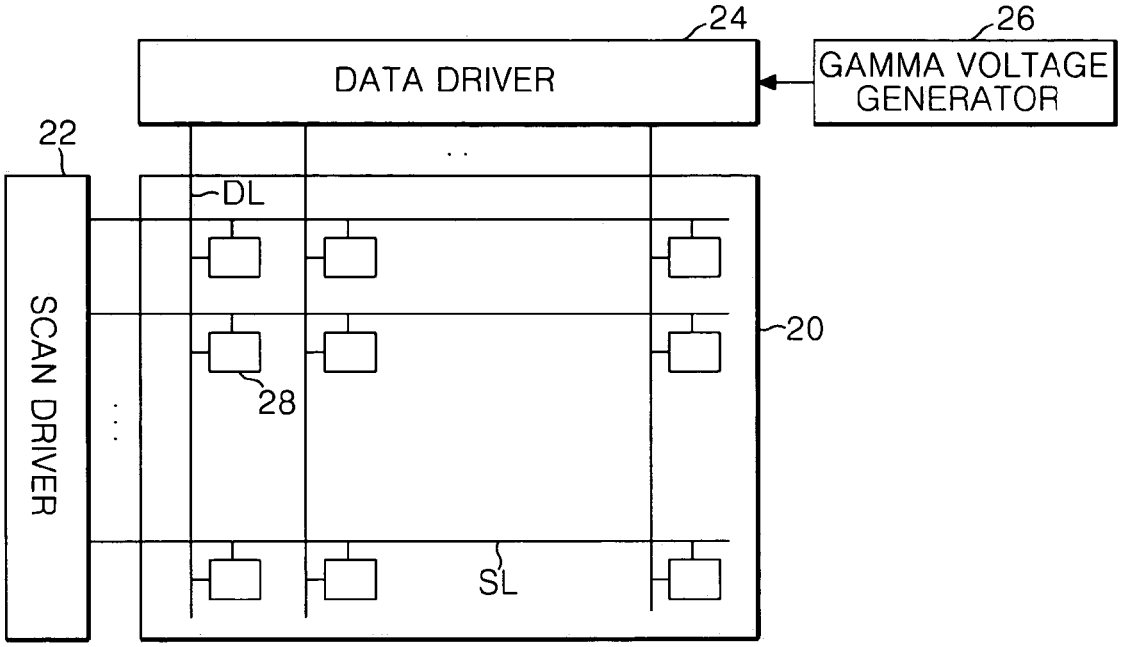
FIG. 1 RELATED ART
FIG. 1 illustrates a schematic view of an active matrix related art organic electro-luminescence device.
Figure 2:
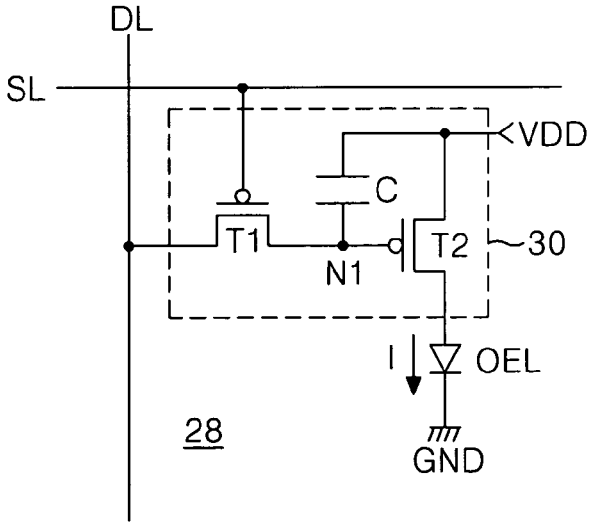
FIG. 2 RELATED ART
FIG. 2 illustrates a related art pixel within the active matrix related art organic electro-luminescence device shown in FIG. 1.
Figure 3:
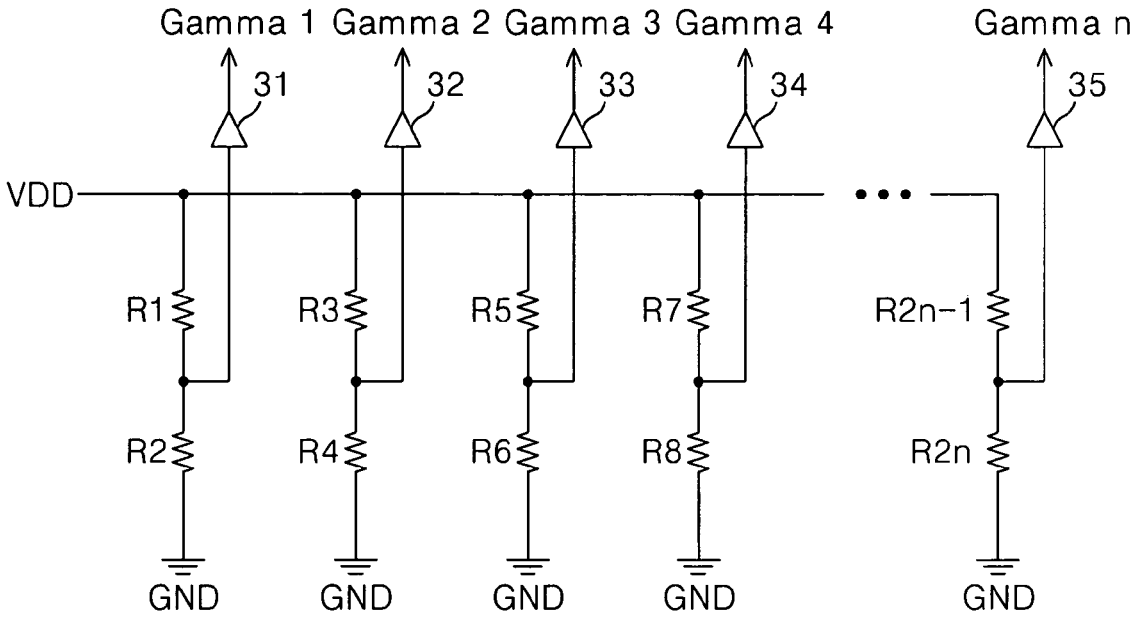
FIG.3 RELATED ART
FIG. 3 illustrates a detailed circuit configuration of a first type within the related art gamma voltage generator shown in FIG. 1.
Figure 4:
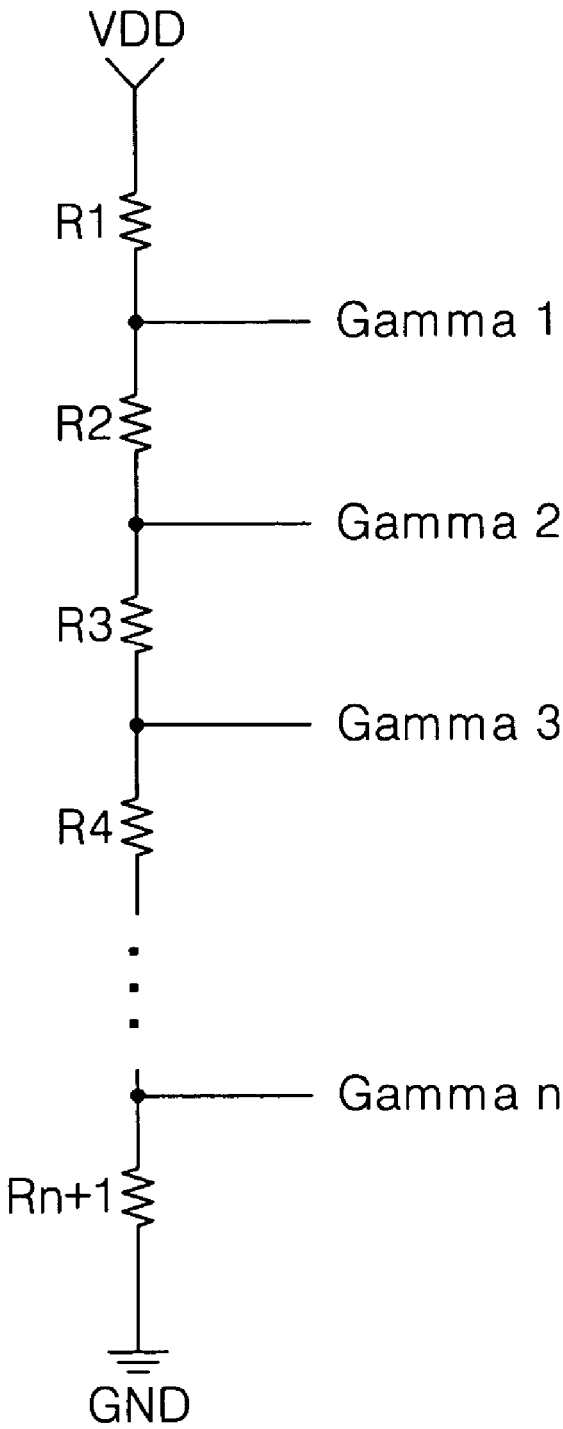
FIG. 4 RELATED ART
FIG. 4 illustrates a detailed circuit configuration of a second type within the related art gamma voltage generator shown in FIG. 1.
Figure 5:
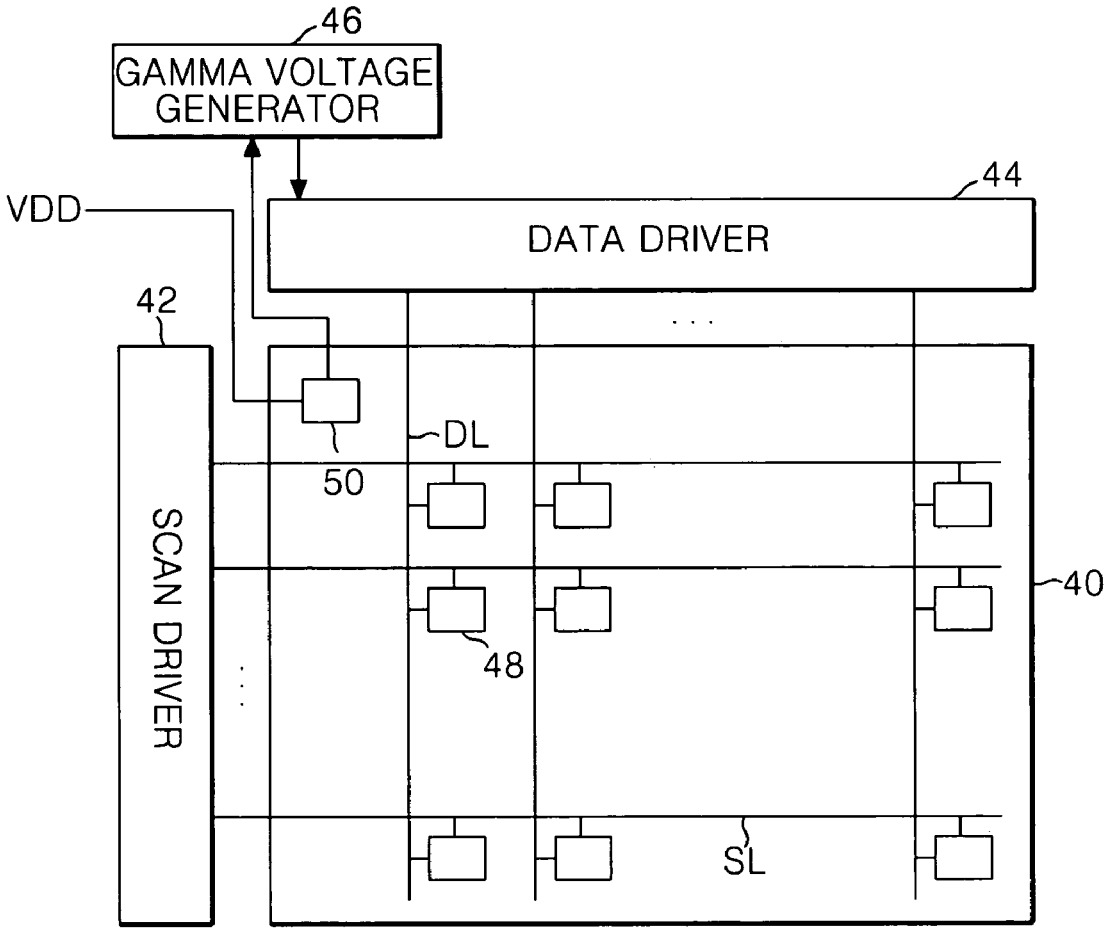
FIG. 5 illustrates an electro-luminescence display device according to the principles of a first aspect of the present invention.

FIG. 5 illustrates an electro-luminescence display device according to the principles of a first aspect of the present invention.

Referring to FIG. 5, an electro-luminescence (EL) display device according to the principles of the present invention may, for example, include an EL panel 40 having a plurality of pixels 48 arranged at areas defined by crossings of scan lines SL and data lines DL, a scan driver 42 for driving the scan lines SL of the EL panel 40, a data driver 44 for driving the data lines DL of the EL panel 40, and a gamma voltage generator 46 for applying a plurality of gamma voltages to the data driver 44.

The scan driver 42 may sequentially apply scan pulses to the scan lines SL, to sequentially drive the scan lines SL, and the data driver 44 may convert externally inputted digital data signals into analog data signals using the gamma voltages applied from the gamma voltage generator 46. Further, the data driver 44 may apply the analog data signals to the data lines DL in synchrony with the application of the scan pulses. The plurality of pixels 48 may receive the analog data signals applied from the data line DL and, when the scan pulses are applied to the scan lines SL, generate light corresponding to the received analog data signal.

Figure 9:
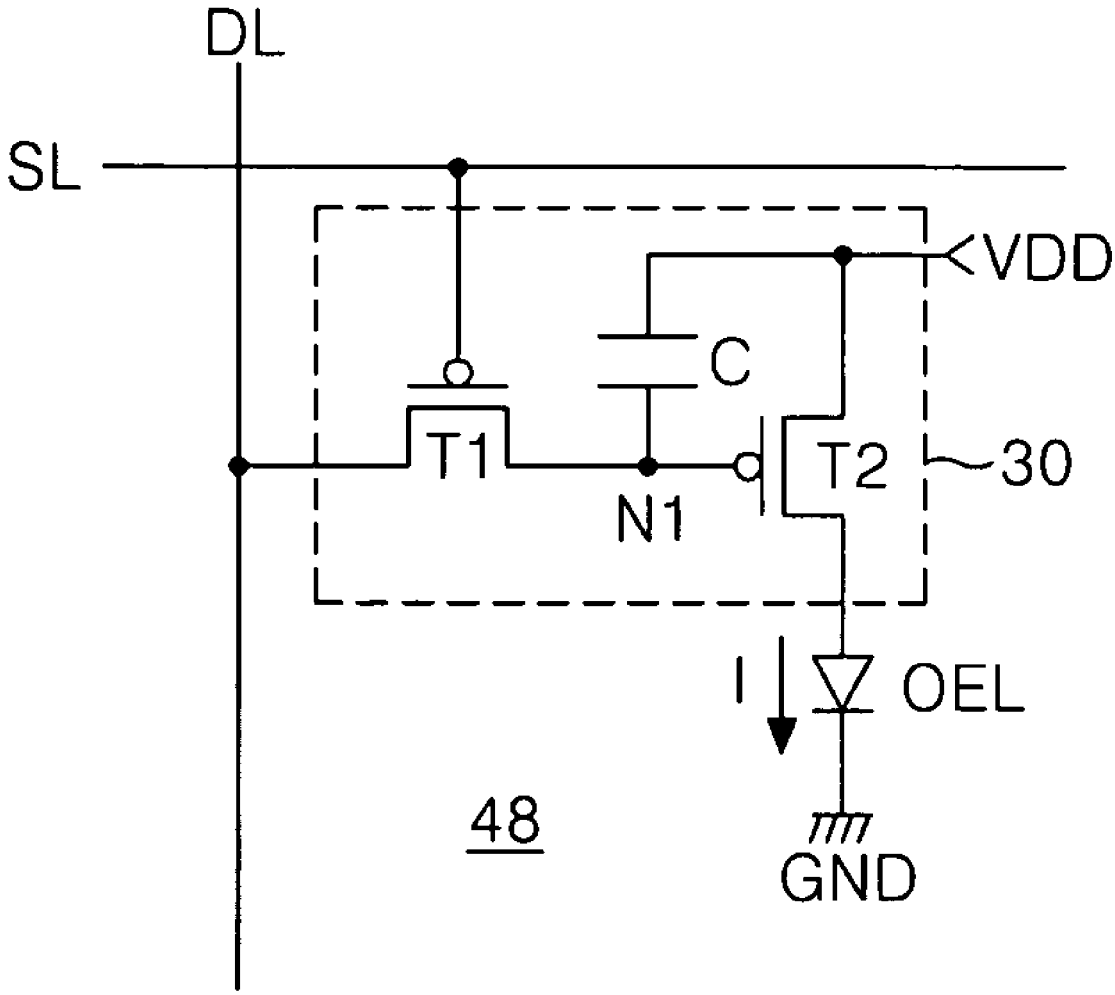
FIG. 9 illustrates an exemplary pixel within the electro-luminescence device shown in FIG. 5.

FIG. 9 illustrates an exemplary pixel within the electro-luminescence device shown in FIG. 5.

Referring to FIG. 9, each pixel 48 may, for example, include an organic electro-luminescence (OEL) cell having a cathode connected to a ground voltage source GND, a cell driver 130 connected to the scan line SL, the data line DL, a supply voltage source VDD, and an anode of the OEL cell for driving the OEL cell.

The cell driver 130 may, for example, include a switch thin film transistor (TFT) T1 having a gate terminal connected to the scan line SL, a source terminal connected to the data line DL, and a drain terminal connected to a first node N1; a drive TFT T2 having a gate terminal connected to the first node N1, a source terminal connected to the supply voltage source VDD, and a drain terminal connected to the OEL cell; and a capacitor C connected between the supply voltage source VDD and the first node N1.

When a scan pulse is applied to the scan lines SL, the switch TFT T1 may be turned on and an analog data signal applied from the data line DL may be transmitted to the first node N1. The analog data signal applied to the first node N1 may then be simultaneously charged to the capacitor C and applied to the gate terminal of the drive TFT T2. In response to the analog data signal applied from the data line DL, the drive TFT T2 may control the amount of current, 1, that may be applied to the OEL cell from the supply voltage source VDD. By controlling the amount of current applied to the OEL cell, the drive TFT T2 may control the luminescence characteristics of the OEL cell. When the switch TFT T1 is turned off, the analog data signal stored by the capacitor C may be discharged, enabling the drive TFT T2 to apply the current, I, from the supply voltage source VDD to the OEL cell. Accordingly, the luminescence characteristics of the OEL cell may be maintained substantially uniformly until an analog data signal of a successive frame is applied to the OEL cell.

Appreciative of the fact that drive TFTs T2 of different EL panels 40 in an electro-luminescence display device may have different threshold voltages due to the manner in which the drive TFTs T2 were fabricated, the EL display device according to a first aspect of the present invention may include a threshold voltage compensator 50 arranged on a portion of the EL panel 40. The threshold voltage compensator 50 may be used to compensate for differences in threshold voltages of drive TFTs T2 formed in different EL panels 40 within the same display system.

In one aspect of the present invention, the threshold voltage compensator 50 may apply a reference voltage to the gamma voltage generator 46, wherein the reference voltage may be substantially equal to the difference between the threshold voltage of the drive TFT T2 and a supply voltage applied by the supply voltage source VDD. The gamma voltage generator 46 may divide the reference voltage applied from the threshold voltage compensator 50 to generate a plurality of gamma voltages and apply the generated plurality of gamma voltages to the data driver 44.

Figure 6:
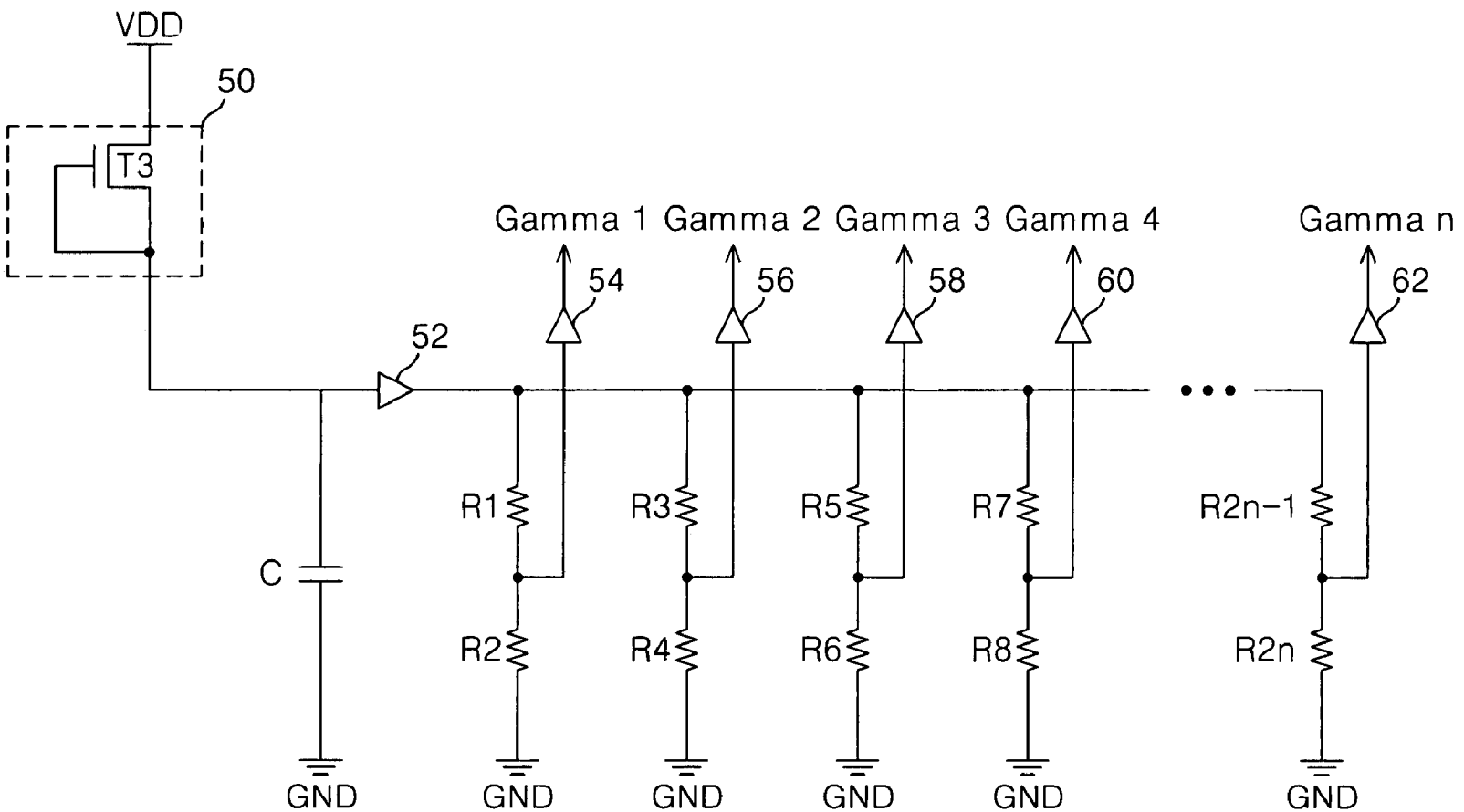
FIG. 6 illustrates a circuit diagram of the threshold voltage compensator and the gamma voltage generator shown in FIG. 5, in accordance with the first aspect of the present invention.

FIG. 6 illustrates a circuit diagram of the threshold voltage compensator and a gamma voltage generator shown in FIG. 5, in accordance with the first aspect of the present invention.

Referring to FIG. 6, the gamma voltage generator 46 may, for example, include a plurality of gamma voltage suppliers (e.g., R, G, and B gamma voltage suppliers), wherein each of the plurality of gamma voltage suppliers may apply gamma voltages to corresponding ones of the R, G, and B OEL cells. For convenience of illustration, however, only one such gamma voltage supplier is illustrated. The threshold voltage compensator 50 may include at least one threshold voltage compensation TFT T3 having a source terminal connected to the supply voltage source VDD and drain and gate terminals connected to at least one gamma voltage supplier.

In one aspect of the present invention, the number of threshold voltage compensation TFTs T3 within the threshold voltage compensator 50 is equal to the number of gamma voltage suppliers within the gamma voltage generator 46 such that a reference voltage may be applied between pairs of threshold voltage compensation TFTs T3 and corresponding ones of the gamma voltage suppliers. In another aspect of the present invention, at least two of the gamma voltage suppliers within the gamma voltage generator 46 may receive a reference voltage generated by the same threshold voltage compensation TFT T3. For example, all of the gamma voltage suppliers within the gamma voltage generator 46 may receive a reference voltage generated by the same threshold voltage compensation TFT T3.

According to the principles of the present invention, the threshold voltage compensation TFT T3 may apply the reference voltage to the gamma voltage supplier, wherein the reference voltage may be substantially equal to the difference between the threshold voltage of the threshold voltage compensation TFT T3 and the supply voltage applied by the supply voltage source VDD. In one aspect of the present invention, the threshold voltage compensation TFT T3 and the drive TFT T2 may be provided in the same EL panel 40 and fabricated in the same processes. Therefore, the threshold voltage of the threshold voltage compensation TFT T3 may be substantially equal to the threshold voltage of the drive TFT T2.

Referring still to FIG. 6, each gamma voltage supplier may divide the reference voltage applied from the threshold voltage compensator 50 to generate n number of gamma voltages GAMMA1 to GAMMAn (where n is a natural number). The n gamma voltages may then be used to generate analog data signals having different brightness levels, in correspondence with the digital data signals externally inputted to the data driver. Accordingly, each gamma voltage supplier within the gamma voltage generator 46 may include a plurality of resistor pairs R1R2, R3R4, R5R6, R7R8, . . . , R2*n*–1R2*n* connected to each other between the threshold voltage compensator 50 and a ground voltage source GND to divide the reference voltage into n number of gamma voltages GAMMA1 to GAMMAn. In one aspect of the present invention, each gamma voltage supplier may further include a capacitor C for maintaining the reference voltage applied by the threshold voltage compensation TFT T3, and a first amplifier 52 for eliminating electromagnetic noise included with the reference voltage. Subsequently, the n gamma voltages having the electromagnetic noise eliminated may be applied to the data driver 44. The data driver 44 may convert the externally inputted digital data signals into analog data signals using any of the n gamma voltages GAMMA1 to GAMMAn. Subsequently, the analog data signals may be applied to the data lines DL, causing predetermined pictures to be displayed by the EL panel 40.

According to the principles of the present invention, each of the gamma voltage suppliers of the gamma voltage generator 46 may generate the gamma voltages using the reference voltage, wherein the reference voltage may be substantially equal to the difference between the threshold voltage of the drive TFT T2 and a supply voltage applied by the supply voltage source VDD. Accordingly, pictures may be displayed at a substantially uniform brightness across a plurality of EL panels 40 incorporated within an electro-luminescence display device.

For example, a drive TFT T2 in a first EL panel of an electro-luminescence display device may have a threshold voltage Vth of about 0.7V while a drive TFT T2 of a second EL panel of the electro-luminescence display device may have a threshold voltage Vth of about 0.3V, wherein the supply voltage source VDD may apply a supply voltage of about 10V. Accordingly, a threshold voltage compensator 50 of the first EL panel may apply a first reference voltage of about 9.3V to the gamma voltage supplier within the gamma voltage generator 46 of the first EL panel while a threshold voltage compensator 50 of the second EL panel may apply a second reference voltage of about 9.7V to the gamma voltage supplier within the gamma voltage generator 46 of the second EL panel. Upon applying the first reference voltage to the first EL panel, the voltage difference (i.e., the difference between the supply voltage applied from the supply voltage source VDD (i.e., about 10V) and the gate voltage (i.e., the first reference voltage of about 9.3V) of the drive TFT T2 of the first EL panel may be about 0.7V. Similarly, upon applying the second reference voltage to the second EL panel, the voltage difference (i.e., the difference between the supply voltage applied from the supply voltage source VDD (i.e., about 10V) and the gate voltage (i.e., the second reference voltage of about 9.3V) of the drive TFT T2 of the second EL panel may be about 0.3V. Accordingly, the voltage difference of the drive TFTs T2 of the first and second EL panels is substantially equal to the respective threshold voltages of the drive TFTs T2 of the first and second EL panels. Therefore, when EL panels within an electro-luminescence display device are each supplied with substantially equal supply voltages (e.g., about 10V), the voltage differences of each of the TFTs T2 in the EL panels corresponds to the threshold voltages Vth of each of the TFTs T2 in the EL panels and the amount of current flowing through the drive TFTs T2 of each of the EL panels is substantially the same.

Accordingly, pictures may be displayed at a substantially uniform brightness across a plurality of EL panels 40 incorporated within an electro-luminescence display device regardless of the difference between the threshold voltages Vth of the drive TFTs T2 of different EL panels within an electro-luminescence display device. For example, when a first reference voltage of about 4.3V is applied to a first EL panel, the gate voltage of the drive TFT T2 (having a threshold voltage of about 0.7V) of the first EL panel (i.e., the voltage of the analog data signal applied to the gate terminal of the drive TFT T2) may be about 5V (4.3V+0.7V). As a result, OEL cells of the first EL panel may be supplied with a current corresponding to the voltage difference (i.e., a difference between the supply voltage applied from the supply voltage source VDD and the gate voltage) of about 5V (i.e., about 10V−5V), and pictures may be expressed by the first EL panel accordingly. Similarly, when a second reference voltage of about 4.7V is applied to a second EL panel, the gate voltage of the drive TFT T2 (having a threshold voltage of about 0.3V) of the second EL panel (i.e., the voltage of the analog data signal applied to the gate terminal of the drive TFT T2) may be about 5V (4.7V+0.3V). As a result, OEL cells of the second EL panel may be supplied with a current corresponding to the voltage difference (i.e., a difference between the supply voltage applied from the supply voltage source VDD and the gate voltage) of about 5V (i.e., about 10V−5V), and pictures may be expressed by the second EL panel accordingly.

Therefore, and in accordance with the principles of the present invention, the influence of the threshold voltage Vth of drive TFTs T2 within each EL panel may be implemented by the threshold voltage compensator 50, prior to the generation of the gamma voltages. As a result, pictures may be displayed at a substantially uniform brightness across a plurality of EL panels 40 incorporated within an electro-luminescence display device.

According to the principles of the present invention, the threshold voltage compensators 50 may be arranged variously within each EL panel. For example, the threshold voltage compensator 50 may be connected to the gamma voltage generator 46 via a dummy terminal of a data tape carrier package (TCP) or a scan TCP (not shown), wherein the data TCP may be used to electrically connect the data driver 44 to the EL panel 40 and the scan TCP may be used to electrically connect the scan driver 42 to the EL panel 40. In another aspect of the present invention, the threshold voltage compensator 50 may be connected to the gamma voltage generator 46 via a separate flexible printed circuit (FPC) not shown.

Figure 7:
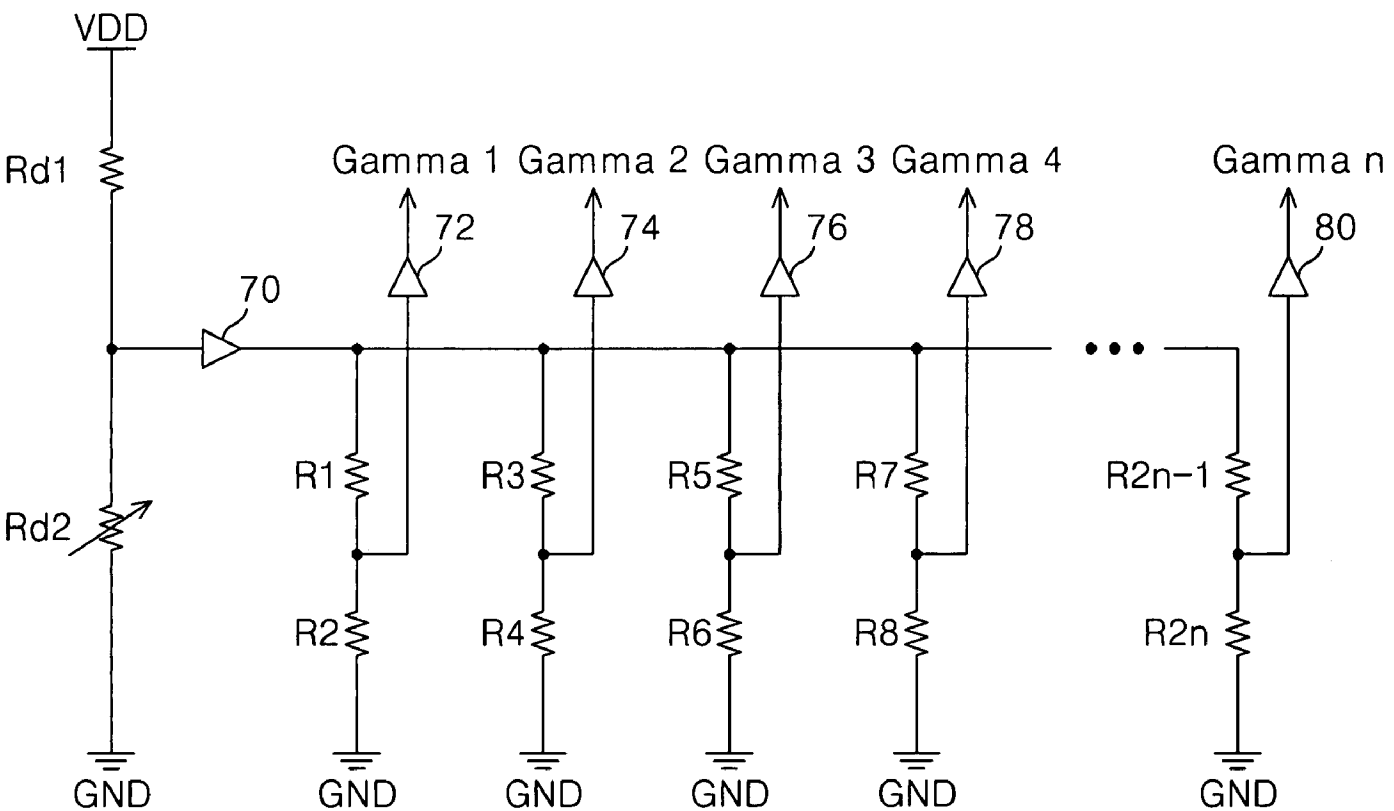
FIG. 7 illustrates a circuit diagram of a gamma voltage generator in accordance with a second aspect of the present invention.

FIG. 7 illustrates a circuit diagram of a gamma voltage generator in accordance with a second aspect of the present invention.

Referring to FIG. 7, the gamma voltage generator 46 may, for example, include a plurality of gamma voltage suppliers (e.g., R, G, and B gamma voltage suppliers), wherein each of the plurality of gamma voltage suppliers may apply gamma voltages to corresponding ones of the R, G, and B OEL cells. For convenience of illustration, however, only one such gamma voltage supplier is illustrated.

According to the principles of the present invention, each gamma voltage supplier within the gamma voltage generator 46 may, for example, include a first voltage division resistor Rd1 and a second voltage division resistor Rd2 connected to each other in series between a supply voltage source VDD and a ground voltage source GND for dividing the supply voltage applied from the supply voltage source VDD, thereby generating a reference voltage.

Further, each gamma voltage supplier may, for example, include a plurality of resistor pairs R1R2, R3R4, R5R6, R7R8, . . . , and R2*n*−1R2*n* for dividing the reference voltage generated by the first and second voltage division resistors Rd1 and Rd2 and for generating n number of gamma voltages GAMMA1 to GAMMAn (where n is a natural number). The n gamma voltages may then be used to generate analog data signals having different brightness levels, in correspondence with the digital data signals externally inputted to the data driver. In one aspect of the present invention, each gamma voltage supplier may further include a first amplifier 70 for eliminating electromagnetic noise included with the reference voltage. Further, each gamma voltage supplier may also include a plurality of second amplifiers 72, 74, 76, 78, and 80 for eliminating electromagnetic noise included with the gamma voltages GAMMA1 to GAMMAn generated at the resistor pairs R1R2, R3R4, R5R6, R7R8, . . . , R2*n*−1R2*n*, respectively. Subsequently, the n gamma voltages having the electromagnetic noise eliminated may be applied to the data driver 44. The data driver 44 may convert the externally inputted digital data signals into analog data signals using any of the n gamma voltages GAMMA1 to GAMMAn. Subsequently, the converted analog data signals may be applied to the data line DL, causing predetermined pictures to be displayed by the EL panel 40.

According to the principles of the present invention, the gamma voltage suppliers of the gamma voltage generator 46 may compensate for the values in the threshold voltages of drive TFTs T2 in each EL panel of an electro-luminescence display device using the first and second voltage division resistors Rd1 and Rd2. In one aspect of the present invention, the second voltage division resistor Rd2 may be provided as a variable resistor having an adjustable resistance capable of compensating for the threshold voltage Vth of drive TFTs T2 provided within EL panels 40. In another aspect of the present invention, the resistance of the second voltage division resistor Rd2 may be adjustedto compensate for the threshold voltage Vth of the drive TFT T2 after forming the EL panel 40. Accordingly, the second voltage division resistor Rd2, arranged within each gamma voltage supplier and electrically connected to the EL panel may enable pictures to be displayed at a substantially uniform brightness across a plurality of EL panels 40 incorporated within an electro-luminescence display device. In yet another aspect of the present invention, the n number of gamma voltages GAMMA1 to GAMMAn can be controlled using the adjustable resistance of the second voltage division resistor Rd2.

Figure 8:
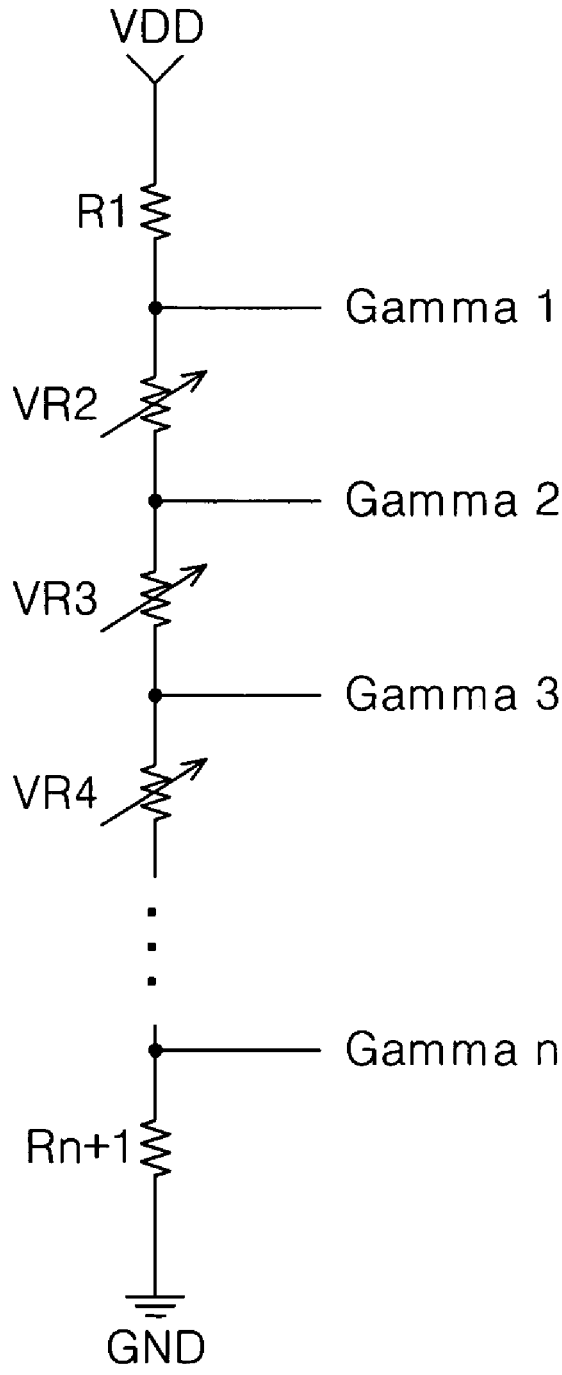
FIG. 8 illustrates a circuit diagram of a gamma voltage generator in accordance with a third aspect of the present invention.

FIG. 8 illustrates a circuit diagram of a gamma voltage generator in accordance with a second aspect of the present invention.

Referring to FIG. 8, the gamma voltage generator 46 may, for example, include a plurality of gamma voltage suppliers (e.g., R, G, and B gamma voltage suppliers), wherein each of the plurality of gamma voltage suppliers may apply gamma voltages to corresponding ones of the R, G and B OEL cells. For convenience of illustration, however, only one such gamma voltage supplier is illustrated.

According to the principles of the present invention, each gamma voltage supplier of the gamma voltage generator 46 may, for example, generate n number of gamma voltages GAMMA1 to GAMMAn (where n is a natural number). The n gamma voltages may then be used to generate analog data signals having different brightness levels, in correspondence with the digital data signals externally inputted to the data driver. Each gamma voltage supplier may, for example, include two fixed resistors R1 and Rn+1 and (n−1) number of variable resistors VR2, VR3, VR4, . . . , VR(n−1) (where n is a natural number) connected in series between a supply voltage source and a ground voltage source GND and between the fixed resistors R1 and Rn+1. Each of the fixed resistors R1 and Rn+1 may be connected to the supply voltage source VDD or the ground voltage source GND. According to the principles of the present invention, the resistances of the variable resistors VR2, VR3, VR4, . . . V(n−1) may be adjusted to compensate the threshold voltage of drive TFTs T2 such that pictures may be displayed at a substantially uniform brightness across a plurality of EL panels 40 incorporated within an electro-luminescence display device.

In accordance with the principles of the present invention, the number of variable resistors VR and the number of fixed resistors R included in the gamma voltage supplier can be varied. For example, gamma voltages may be generated by gamma voltage suppliers including only variable resistors VR. Accordingly, the variable resistors VR and the fixed resistors R can be variously arranged within each gamma voltage supplier to include at least one variable resistor VR.

As described above, threshold voltage values of the drive TFTs of each electro-luminescence panel may be compensated for using the gamma voltages. Accordingly, pictures may be displayed at a substantially uniform brightness across a plurality of EL panels incorporated within an electro-luminescence display device.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An electro-luminescence display device, comprising:

a panel;

a plurality of data lines arranged within the panel;

a supply voltage source for applying a supply voltage to the panel;

a data driver for receiving externally inputted digital data signals and for applying analog data signals to the plurality of data lines in correspondence with the externally inputted digital data signals;

a gamma voltage generator for generating a plurality of gamma voltages having a plurality of voltage levels, wherein the gamma voltages are usable in forming the analog data signals; and a threshold voltage compensator arranged between the gamma voltage generator and the supply voltage source for controlling the supply voltage to compensate for a threshold voltage of drive thin film transistors and for applying the controlled supply voltage to the gamma voltage generator.

2. The electro-luminescence display device according to claim 1, wherein the panels includes:

a plurality of electro-luminescence cells arranged in a matrix pattern; and a plurality of drive thin film transistors for applying a current to corresponding ones of the plurality of electro-luminescence cells, wherein the current corresponds to a reference voltage substantially equal to a difference between a threshold voltage of the drive thin film transistors and the supply voltage.

3. The electro-luminescence display device according to claim 2, wherein the threshold voltage compensator lowers the supply voltage and applies the lowered supply voltage to the gamma voltage generator.

4. The electro-luminescence display device according to claim 3, wherein the threshold voltage compensator applies the reference voltage to the gamma voltage generator; and the gamma voltage generator divides the reference voltage.

5. The electro-luminescence display device according to claim 3, wherein the threshold voltage compensator includes at least one threshold voltage compensation thin film transistor.

6. The electro-luminescence display device according to claim 5, wherein the at least one threshold voltage compensation thin film transistor includes:

a source electrode connected to the supply voltage source;

a drain electrode connected to the gamma voltage generator; and a gate electrode connected to the gamma voltage generator.

7. The electro-luminescence display device according to claim 5, wherein a threshold voltage of the threshold voltage compensation thin film transistor is substantially equal to a threshold voltage of the plurality of drive thin film transistors.

8. The electro-luminescence display device according to claim 5, wherein the panel includes:

at least one red electro-luminescence cell for expressing red light;

at least one green electro-luminescence cell for expressing green light; and at least one blue electro-luminescence cell for expressing blue light; and wherein the gamma voltage generator includes:

a red gamma voltage supplier for generating a gamma voltage appliable to the at least one red electro-luminescence cell;

a green gamma voltage supplier for generating a gamma voltage appliable to the at least one green electro-luminescence cell; and a blue gamma voltage supplier for generating a gamma voltage appliable to the at least one blue electro-luminescence cell.

9. The electro-luminescence display device according to claim 8, wherein the threshold voltage compensator includes three threshold voltage compensation thin film transistors connected to corresponding ones of the red, green, and blue gamma voltage suppliers.

10. The electro-luminescence display device according to claim 1, further comprising:

a scan driver coupled to the panel for controlling the application of the analog data signals;

a scan tape carrier package for electrically connecting the scan driver to the panel;, and a data tape carrier package for electrically connecting the data driver to the panel.

11. The electro-luminescence display device according to claim 10, wherein the threshold voltage compensator is electrically connected to the gamma voltage generator via the scan tape carrier package.

12. The electro-luminescence display device according to claim 10, wherein the threshold voltage compensator is electrically connected to the gamma voltage generator via the data tape carrier package.

13. The electro-luminescence display device according to claim 1, further comprising a flexible printed circuit for electrically connecting the threshold voltage compensator to the gamma voltage generator.

14. An electro-luminescence display device, comprising:

a plurality of panels wherein each of the panels include a plurality of electro-luminescence cells arranged in a matrix pattern; and a plurality of drive thin film transistors for applying a current to corresponding ones of the electro-luminescence cells, wherein the current corresponds to the analog data voltage;

a plurality of drive thin film transistors for applying a current to corresponding ones of the electro-luminescence cells, wherein the current corresponds to the analog data voltage;

data drivers coupled to each of the plurality of panels for receiving externally inputted digital data signals; and a plurality of red, green, and blue gamma voltage suppliers coupled to each of the data drivers for dividing a supply voltage applied by a supply voltage source into a plurality of gamma voltages, wherein the plurality of gamma voltages are usable in forming analog data voltages corresponding to the received externally inputted digital data signals, wherein each of the gamma voltage suppliers includes:

a fixed resistor and a variable resistor connected in series to the supply voltage source and to a ground voltage source for dividing the supply voltage; and a plurality of resistor pairs connected in parallel for generating the gamma voltages using the divided supply voltage;

wherein a resistance of the variable resistor is adjustable to compensate for threshold voltages of drive thin film transistors in different ones of the plurality of panels, wherein threshold voltages of drive thin film transistors of different panels are different.

15. The electro-luminescence display device according to claim 14 wherein a resistance of the variable resistor is adjustable such that pictures are displayable by the plurality of panels at a substantially uniform brightness.

16. A method of driving an electro-luminescence display device, comprising: providing a plurality of panels, wherein each panel includes a plurality of thin film transistors;

providing a power voltage control circuit to each of the plurality of panels;

providing a common power voltage to each of the power voltage control circuits;

controlling a common power voltage appliable by each of the power voltage control circuits in accordance with a threshold voltage of the thin film transistors in each of the panels; and generating a gamma voltage within each of the panels using corresponding ones of the controlled common power voltages.

17. The method of driving according to claim 16, wherein each power voltage control circuit lowers corresponding ones of the common power voltages.

18. The method of driving according to claim 17, wherein each power voltage control circuit lowers the common power voltage to a level substantially equal to the threshold voltage of the thin film transistors in corresponding ones of the panels.

19. A method of driving an electro-luminescence display device, comprising:

providing a plurality of panels;

providing a plurality of thin film transistors within each of the plurality of panels, wherein each plurality of thin film transistors includes a threshold voltage;

providing a gamma voltage generator to each of the plurality of panels for generating a plurality of gamma voltages;

applying a common power voltage to each of the gamma voltage generators; and generating the plurality of gamma voltages in accordance with the threshold voltage of each plurality of thin film transistors.

20. The method of driving according to claim 19, further comprising applying the same data signals to the panels, wherein each gamma voltage generator generates the gamma voltages such that pictures are displayable at a substantially uniform brightness by the plurality of panels to which the data signals are applied.

21. An electro-luminescence display device, comprising:

a plurality of panels;

a data driver provided to each of the plurality of panels for receiving externally inputted data signals; and a plurality of gamma voltage generators, each associated with one of the plurality of panels, provided to each data driver for applying a plurality of gamma voltages to corresponding ones of the data drivers, wherein the gamma voltages are usable in forming analog data signals corresponding to the externally inputted data signals and wherein different gamma voltages are appliable by different gamma voltage generators such that pictures are displayable at a substantially uniform brightness by the plurality of panels.

22. The electro-luminescence display device according to claim 21, wherein each gamma voltage generator includes at least one variable resistor.

23. The electro-luminescence display device according to claim 22, wherein a resistance of each variable resistor is adjustable such that pictures are displayable at a substantially uniform brightness by the plurality of panels.

24. The electro-luminescence display device according to claim 22, wherein each gamma voltage generator includes:

a first and a second fixed resistor connected to a supply voltage source and a ground voltage source, respectively; and a plurality of variable resistors connected between the first and second fixed resistors.

25. The electro-luminescence display device according to claim 24, wherein a resistance of each variable resistor is adjustable such that pictures are displayable at a substantially uniform brightness by the plurality of panels.

26. The electro-luminescence display device according to claim 25, wherein each of the panels includes:

a plurality of electro-luminescence cells arranged in a matrix pattern; and a plurality of drive thin film transistor for applying a current to corresponding ones of the plurality of electro-luminescence cells, wherein the current corresponds to the analog data voltage.

27. The electro-luminescence display device according to claim 26, wherein the resistance of each variable resistor is adjustable to compensate for threshold voltages of drive thin film transistors of each of the plurality of panels.

28. The electro-luminescence display device according to claim 26, wherein each panel includes:

at least one red electro-luminescence cell for expressing red light;

at least one green electro-luminescence cell for expressing green light; and at least one blue electro-luminescence cell for expressing blue light; and wherein each gamma voltage generator includes:

a red gamma voltage supplier for generating a gamma voltage appliable to the at least one red electro-luminescence cell;

a green gamma voltage supplier for generating a gamma voltage appliable to the at least one green electro-luminescence cell; and a blue gamma voltage supplier for generating a gamma voltage appliable to the at least one blue electro-luminescence cell.

* * * * *